United States Patent [19]

Fisher

[11] 4,194,591

[45] Mar. 25, 1980

[54] MOBILE SCAFFOLD WITH FIXED-USE-POSITION OUTRIGGERS

[75] Inventor: Robert E. Fisher, Berkeley, Calif.

[73] Assignee: Up-Right, Inc., Berkeley, Calif.

[21] Appl. No.: 925,174

[22] Filed: Jul. 17, 1978

[51] Int. Cl.[2] ..... E04G 1/34; E04G 1/30; E04G 1/24

[52] U.S. Cl. ..... 182/17; 182/63; 182/101; 182/116; 182/127; 182/152

[58] Field of Search ..... 182/141, 148, 17, 63, 182/107, 108, 172, 152, 127, 116, 101; 214/86 R

[56] References Cited

U.S. PATENT DOCUMENTS

| | | | |
|---|---|---|---|
| 294,860 | 3/1884 | Dye | 182/17 |
| 2,409,622 | 10/1946 | Gottfried | 182/172 |
| 2,964,122 | 12/1960 | Funk | 182/17 |

*Primary Examiner*—Reinaldo P. Machado

*Attorney, Agent, or Firm*—Lempio & Majestic Phillips, Moore, Weissenberger

[57] ABSTRACT

A pedestal scaffold having casters on the scaffold base to permit the scaffold to be rolled horizontally while the scaffold is in a generally vertical position. Retractable outriggers are extended outwardly and locked in position to provide a large support area for the scaffold, with the act of extension and locking of the outriggers causing the casters to lift off the ground so that the scaffold cannot be moved when in use. When the outriggers are not in use and the scaffold is movable on its casters, the casters support the scaffold with a substantial tilt from elevation so that it cannot be used. Additional wheel support frames are provided so that the scaffold can be tilted down for rolling transport, such wheel support frames also serving to protect the user in case the scaffold should tip over when it is generally vertical and supported on its base casters.

19 Claims, 12 Drawing Figures

MOBILE SCAFFOLD WITH FIXED-USE-POSITION OUTRIGGERS

TECHNICAL FIELD

This invention relates to scaffolds, and more particularly to mobile pedestal type scaffolds such as are disclosed in U.S. Pat. No. 2,964,122, issued Dec. 13, 1960, No. 3,327,810, and issued June 27, 1967.

BACKGROUND ART

In many scaffolds a work cage is mounted on a columnar support structure which is usually telescopic in nature so as to be compact for mobility and storage and vertically extendible, manually, pneumatically, or hydraulically, so as to permit the workman to reach substantial ceiling heights.

Scaffolds of this type require a large base support area to provide stability to the scaffold when in use. The larger base support area can be obtained by using a large permanent base structure, but this will prevent the scaffold from being moved from place to place through restricted passageways. To overcome this deficiency, outrigger members are in general use, the outriggers being retractable for movement of the scaffold and extendible when the scaffold is to be used. However, since setting of the outriggers requires some degree of effort on the part of the workman, there may be instances in which a careless workman may fail to set the outriggers.

As a consequence, it is desired to provide a scaffold with such a relatively small base structure in its mobile mode that it will be plainly apparent that the outrigger members attached to the scaffold must be set in their operative position before the workman may safely ascend the scaffold.

Mobile scaffolds are conventionally mounted on lockable casters to permit the scaffolds to be moved from place to place when the casters are unlocked and to permit the scaffold to be immobilized when the casters are locked. However, some type of work may require frequent movement of the scaffold at a work site, as for example, when ceiling lights are replaced. In such situations, and in complete disregard of manufacturer's recommendation and safety regulations, the workman may deliberately choose to leave the casters unlocked. By so doing, he is then able to mount to and stay in the elevated cage and move the scaffold along the floor by grasping the ceiling or wall and exerting a horizontal pull to roll the scaffold on its unlocked casters. Or else, he may have another workman at the base of the scaffold push the scaffold along the floor. In either case, if one or more of the casters encounters an obstacle on the floor, there is a possibility that the scaffold could be tipped over.

As a consequence, in pedestal type scaffolds which are equipped with casters for movement of the scaffold, there is a definite advantage in providing an arrangement wherein the scaffold cannot be moved when a workman is on the scaffold.

DISCLOSURE OF INVENTION

The present invention is directed to overcoming one or more of the problems as set forth above.

In general, the present invention provides a mobile scaffold with outriggers having a non-rolling ground-engageable pads thereon, the outriggers being retractable so that the scaffold is quite compact for rolling movement on the scaffold casters. When at the work site, the outriggers are extended and locked in place so that their pads engage the ground outwardly from the scaffold base to provide a large support area for the scaffold, with the act of extension of the outriggers causing the scaffold casters to lift off of the ground. As a result, with the scaffold being supported only by non-rolling outrigger pads, the scaffold cannot be moved along the ground.

The present invention provides a number of features to prevent use of the scaffold when the outriggers are not properly set and locked in place. First of all, the base of the scaffold is equipped with casters which allow the scaffold to be easily rolled when the scaffold is generally vertical, with the center of gravity of the scaffold being within the spacing of the supporting casters. However, these casters are arranged so that the scaffold has a pronounced tilt from vertical so as to discourage anyone from trying to climb the scaffold at such time. When the outriggers are properly set and locking in place, such action will cause the scaffold to become vertical.

Yet further, if the scaffold is supported on its base casters, i.e., with a perceptible lean from vertical, and some, but not all, of the outriggers are set so that the scaffold becomes vertical, an attempt to climb the scaffold will cause it to tilt in the opposite direction, but not fall. Such tilting movement will inform the user that all of the outriggers have not been set.

Still further, lockable braces are provided for the outriggers, these braces being comprised of two hinged-together tubes connected to the scaffold and outriggers so that the brace tubes pivot into in-line relations when the outriggers are moved from retracted position to operative position. When in their in-line relation, the brace tubes are locked together against relative movement to provide a rigid brace to keep the outriggers in the operative position. At least some of their braces are arranged so that if the outrigger with which the brace is associated has been moved to its operative position but the brace tubes therefore have not actually locked together, the brace tubes will automatically fold substantially away from their in-line position so that it is readily apparent that the outrigger has not been locked in operative position.

Other aspects of the invention will be set forth in the course of the following detailed description.

BRIEF DESCRIPTION OF DRAWINGS

In the drawings, forming a part of the application, and in which like parts are designated by like reference numbers throughout the same.

BEST MODE FOR CARRYING OUT THE INVENTION

Figure 1:
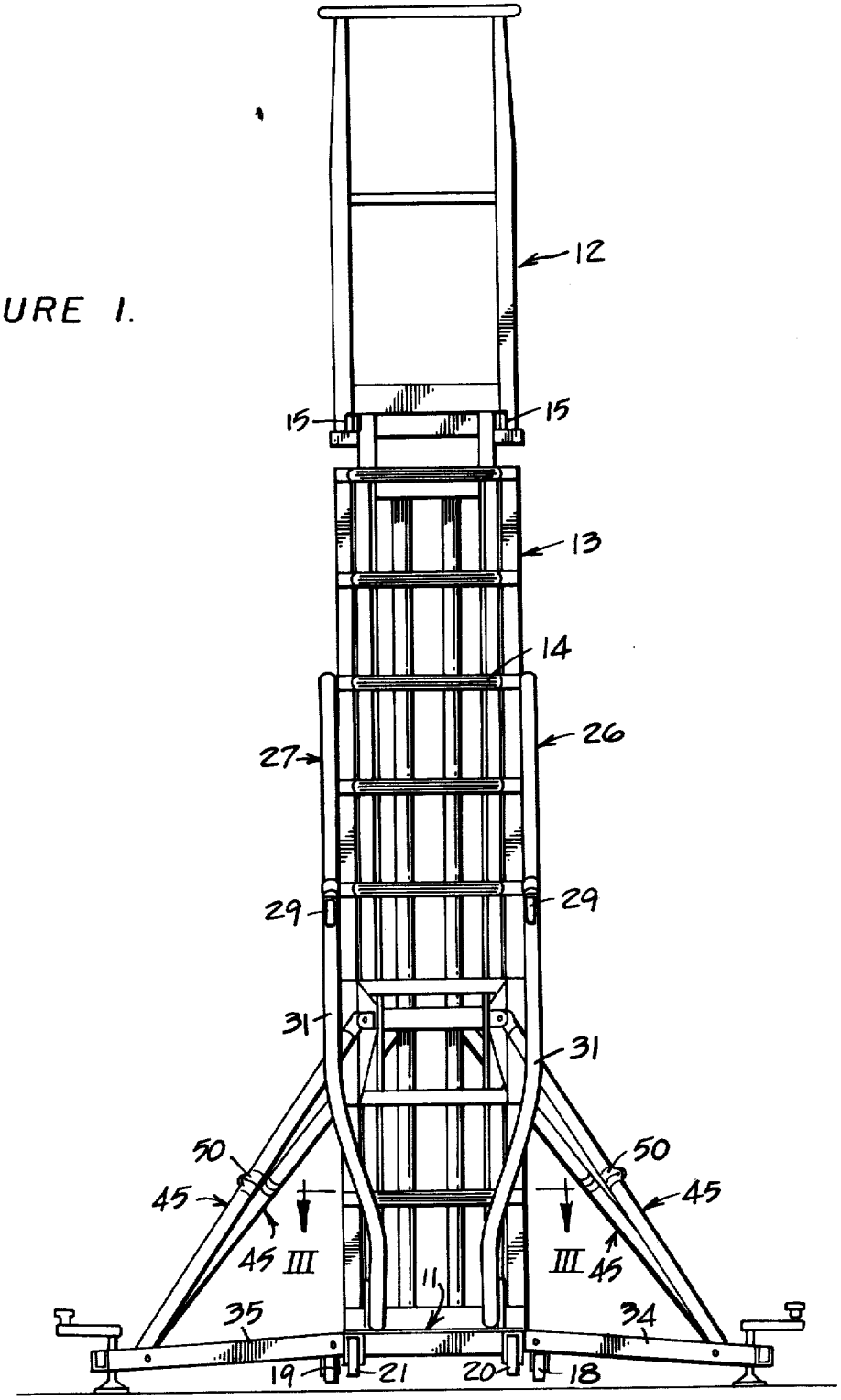
FIG. 1 is a front, or ladder, side of a pedestal scaffold constructed in accordance with the invention, the scaffold being set up for use.

Referring now to the drawings, wherein a preferred embodiment of the invention is shown, the pedestal scaffold 10 comprises a base 11, an elevated work station 12, and a vertically extending column 13 mounted on the base to support the work station thereabove. In the particular embodiment disclosed herein, column 13 comprises a ladder unit having a climbing side 14, the ladder unit preferably being of the telescopic type so that the work station cage 12 may be raised to a desired elevation when the scaffold is to be used. The work station cage 12 is preferably pivoted at 15 so that it can be swung down to a storage position parallel to the ladder unit and latched thereto (by a suitable latch, not shown), as seen in FIG. 2, or swung upwardly and latched by latch elements 15*a* and 15*b* in the operative position, illustrated in FIG. 1.

By way of definition herein, the climbing side of the ladder unit 13 is designated as the rear side of the scaffold, while the side opposite thereto is designated as the forward side.

Figure 2:
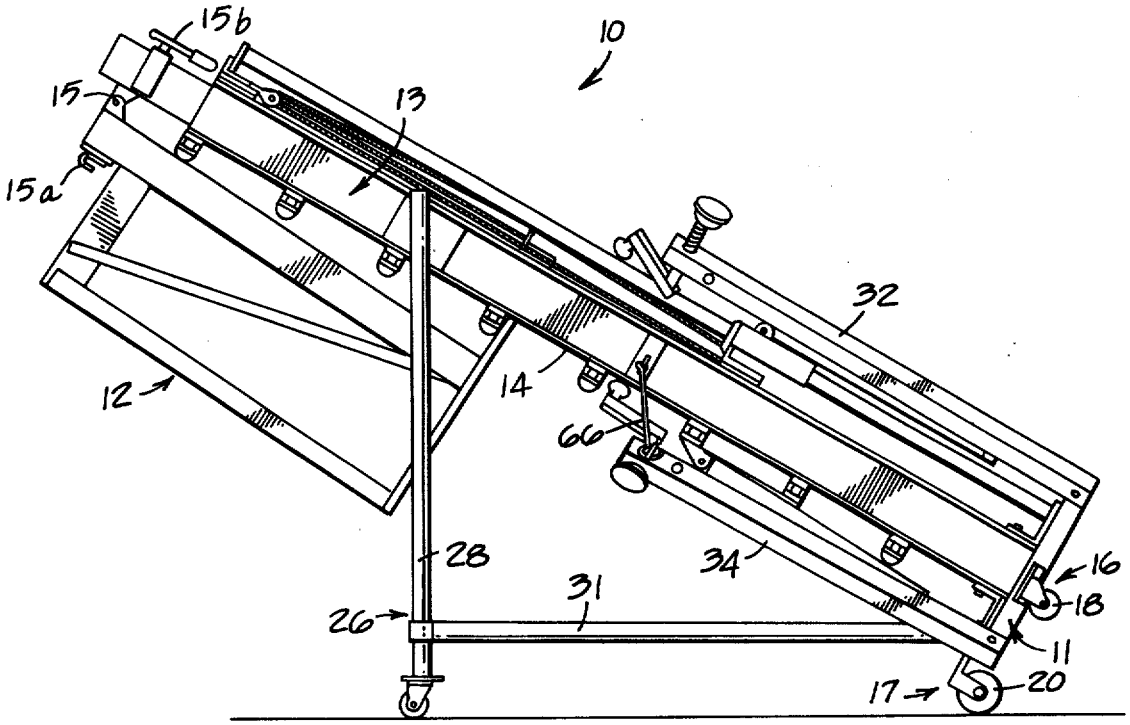
FIG. 2 is a side view of the pedestal scaffold of FIG. 1, retracted and supported for rolling movement.
Figure 3:
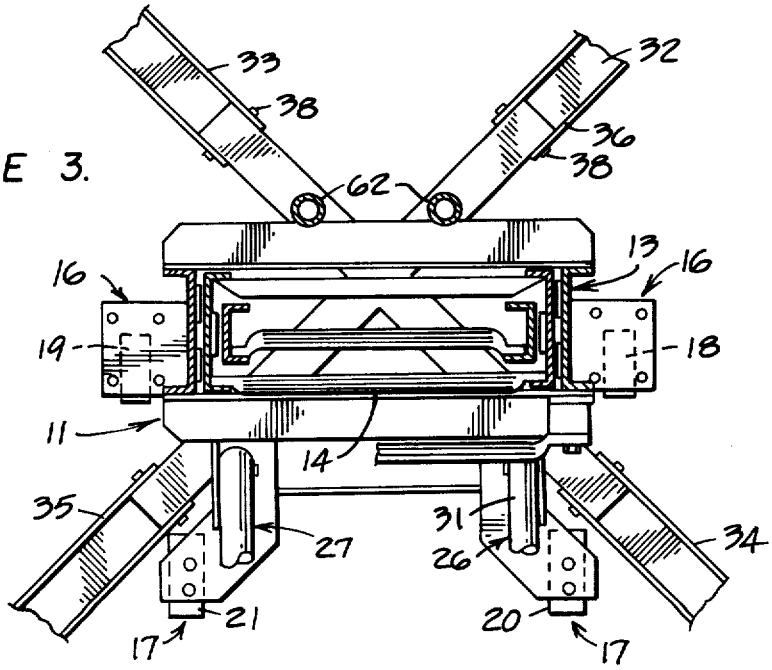
FIG. 3 is a sectional view of the pedestal scaffold, taken on line 3—3 of FIG. 1.

As best seen in FIGS. 1 and 3, the base 11 is supportable on the ground for limited horizontal movement when the ladder unit is generally vertical, or during setting up of the scaffold, by first and second ground-engageable caster means 16 and 17, caster means 16 including two spaced apart casters 18 and 19 located on the base on a transverse axis which is near the center of the ladder unit 13. Caster means 17 includes two spaced apart casters 20 and 21 on a transverse axis located rearwardly of the ladder unit. With all four casters 18–21 in engagement with the ground, a quadrilaterally shaped support area will be defined between the points of engagement of the casters with the ground. The casters are also arranged on the base so that the lower surfaces of casters 18 and 19 are below the lower surfaces of casters 20 and 21 when the ladder unit is vertical. As a consequence, when the scaffold is supported by all four casters on level ground, the ladder unit will be rearwardly inclined, with the angle between horizontal and the climbing side 14 of the ladder unit being substantially less than 90°. By "substantially less than 90°" is meant that such angle should be sufficiently less than 90° so that the inclination from vertical is readily perceivable by a workman, the inclination from vertical being limited by the requirement that the center of gravity of the inclined scaffold be vertically within the support area defined by the four casters so that the scaffold is stably supported thereon.

Although four casters are preferably used to provide greater stability, three casters could be used to provide a triangular support area therebetween. In such case, each of the first and second caster means 16 and 17 would have at least one caster, there being at least three casters in all.

Casters 20 and 21 are preferably of the locking variety wherein the casters may be locked against rotation or unlocked for rolling movement of the scaffold.

The scaffold 10 is further provided with parallel and spaced apart wheel support frames 26 and 27, each extending a substantial distance rearwardly from the climbing side 14 of the ladder unit, and on each side thereof. As best seen in FIG. 2, each wheel support frame comprises an elongated tube 28 secured at one end thereof to the ladder unit with a wheel 29 mounted on the other end, and a stabilizing tube 31 extending from tube 28 to base 11. As seen in FIG. 2, the folded-up scaffold can be supported for rolling movement on casters 20 and 21 and wheels 29, with the ladder unit being greatly inclined from vertical so that the scaffold may be rolled through normal-height doorways. Wheels 29 are sufficiently spaced rearwardly from casters 20 and 21 so that the center of gravity of the scaffold, with the ladder unit retracted and with the cage 12 pivoted to working position (FIG. 8), is vertically within the support area defined by the points of ground-engagement of casters 20 and 21 and wheels 29.

Figure 4:
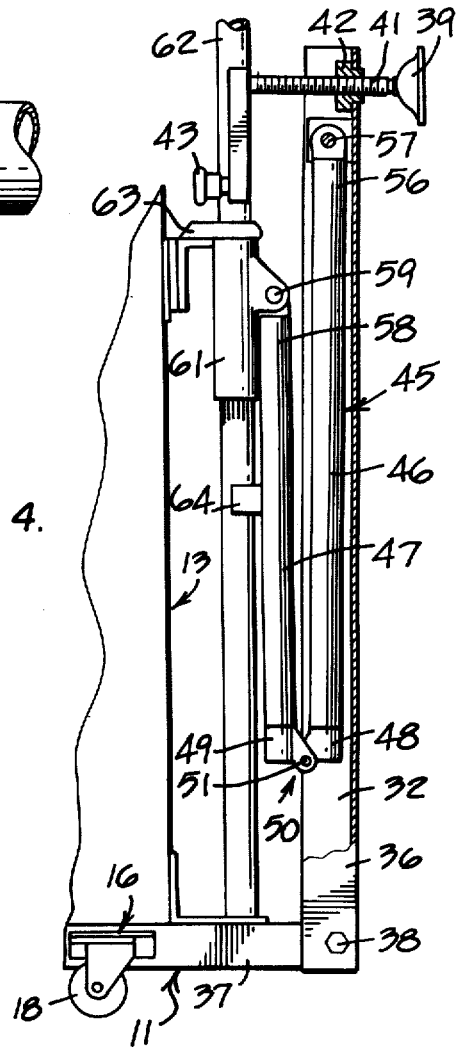
FIG. 4 is an elevational detail of the pedestal scaffold of FIG. 1, showing one of the rear outriggers folded up in retracted position.

Scaffold 10 further includes two elongated forward outrigger members 32 and 33 and two elongated rear outrigger members 34 and 35. As best seen in FIGS. 3 and 4, forward outrigger member 32 comprises a U-shaped channel, open at its top, and pivotally connected at one end 36 thereof to rectangular tube 37 by means of bolt 38, tube 37 being an integral part of base 11. Such pivotal connection allows outrigger 32 to be pivoted upwardly to a retracted storage position wherein it is generally parallel to ladder unit 14, or downwardly to an operative position wherein non-rolling pad element 39 is engageable with the ground outwardly from the base. Pad 39 is mounted on screw 41 threaded through nut 42 which is fixed to the outrigger member 32 so that the spacing between the pad and the bottom of the outrigger member may be adjusted by rotation of handle 43.

Figure 5:
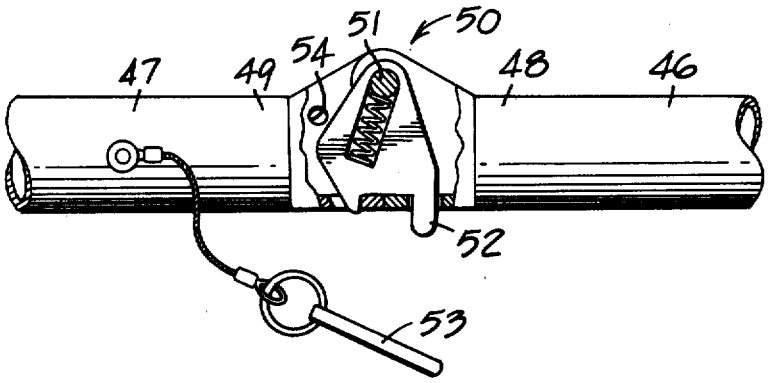
FIG. 5 is a detail view, partly in section, of one of the outrigger brace latches.

A lockable brace means 45 is provided for outrigger member 32, and comprises first and second brace tubes 46 and 47, each having first ends 48 and 49 pivotally connected together for pivotal movement of the brace tubes between a generally parallel relation (FIG. 4) and an in-line relation (FIG. 5) by means of a locking hinge 50 having a hinge pin 51. A suitable lock member 52 is provided for automatically locking the brace tubes against relative movement therebetween when the tubes have been brought into their in-line relation, and for manually unlocking the tubes so that they can be moved from their in-line relation. The releasable locking hinge 50 disclosed herein is more fully shown and described in U.S. Pat. No. 3,187,373. Retainer pin 53 is insertable through aperture 54 of the locking hinge to prevent inadvertent unlocking movement of lock member 52 when the brace tubes are locked together.

The second end 56 of brace tube 46 is pivotally connected to outrigger member 32 by means of pivot pin 57, while the second end 58 of brace tube 47 is pivotally connected to the ladder unit 13 by means of pivot pin 59. Pivot pin 59 is carried by slide member 61, which as disclosed herein, is in the form of a sleeve mounted on tubular guide member 62 for vertical sliding movement, guide member 62 being a part of the ladder unit. A stop plate 63 fixed to the ladder unit is engageable with slide member 61 to limit upward movement of the slide member on guide member 62 when the brace 45 has been locked in in-line relation, thus enabling the weight of the scaffold to be transferred through stop plate 63, slide member 61, and locked brace 45 to outrigger pad 39 when the outrigger is in use. Collar 64 is fixed to guide member 62 to limit downward movement of slide member 61 thereon.

As will be noted in FIG. 4, when the outrigger member 32 has been pivoted upwardly to its storage position, brace tube 46 will lie within the open channel of the outrigger member, thus enabling the outrigger and brace assembly to be very compactly arranged when in the storage position for ease in moving the scaffold through narrow doors or corridors.

The purpose of the slidable pivotal connection of brace tube 47 to the ladder unit is to provide a highly visual indication that the brace tube has not been locked in its in-line relation. If the slide member 61 were to remain in engagement with stop plate 63 as the outrigger member 32 is pivoted downwardly to a working position, such movement of the outrigger would cause the brace tubes to come to, or almost to, an in-line relation. An inattentive workman might glance at the substantially in-line brace tubes and assume they were locked together. However, if in fact they are not so locked, slide member 61 will slide, by gravity, down guide member 62 and come to rest against collar 64. This lowering of pivot pin 59 will cause the brace tubes 46 and 47 to assume the phantom line position of FIG. 5 and will thus provide a highly observable indication that the brace tubes are not in an in-line relation. An upward and outward pull on the brace tubes in the vicinity of the locking hinge 50 will cause the slide member 61 to move up on guide member 62 and into engagement with stop plate 63 as the brace tubes are brought into in-line relation and locked together.

The forward outrigger member 33 is provided with an identical lockable brace means and the rear outrigger member 33 and its brace means to function in the same manner as just described in connection with rear outrigger 32, brace means 45, and vertically slidable slide member 61.

Each of the rear outrigger members 34 and 35 are pivotally connected to rectangular tube members of base 11, and each is provided with a lockable brace means 45, again as previously described. The pivotal connections of the second brace tubes 58 of these brace means to the ladder unit 13 differ, however, in that the pivot pins 59 are fixed relative to the ladder unit and do not move up and down on the ladder unit as do the pivot pins 59 of the forward outrigger brace means. Additionally, suitable hooks 66 are provided on the ladder unit for hooking onto the rear outrigger members 34 and 35 to retain them in their storage positions.

The lengths of the various outrigger members are generally determined by accepted safety standards. Typically, the support area defined by the points of ground-engagement of the outrigger pads is such that the least dimension across the support area from a corner thereof is no less than one-third the height of the scaffold when fully extended vertically.

The overall lengths of the brace means 45 for the various outriggers and the locations of the pivotal connections between the brace means, the outrigger members, and the ladder unit are chosen such that when all of the brace tubes are locked in their in-line relation, all of the casters 18–21 will be positioned above the plane defined by the outrigger pads.

Although the illustrated embodiment uses four outriggers, extending outwardly from the base to provide a generally square support area, three outriggers could be used to provide a triangular support area. However, in such case the outriggers would have to be longer to provide the same stability. Likewise, more than four outriggers could be used, but the relatively small increase in support area achievable with more than four outriggers will not usually justify the increase in cost of the additional outriggers.

Industrial Applicability

The scaffold 10 is most easily moved from place to place when it is as illustrated in FIG. 2, i.e., with the ladder unit 13 telescopically retracted, with the work station cage 12 pivoted back and latched to the ladder unit, with all outriggers pivotally retracted to their storage positions and with the two rear outriggers 34 and 35 latched to the ladder unit, and with the scaffold resting on casters 20 and 21 and wheels 29.

Figure 7:
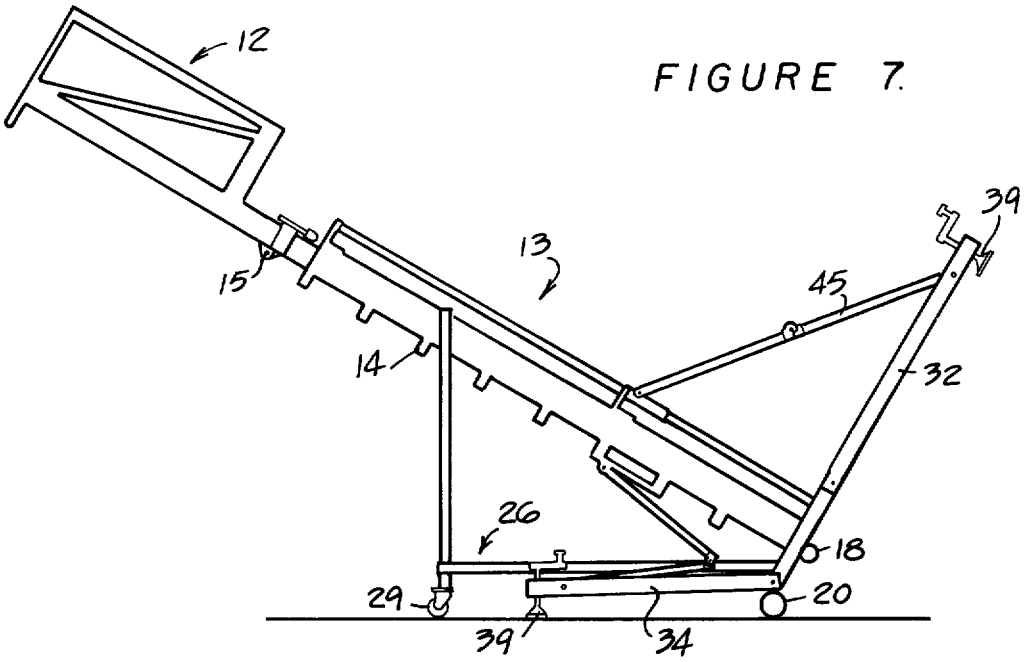
FIGS. 7–10 are simplified views of the pedestal scaffold in FIG. 1, illustrating the manner in which the scaffold is set up for use.

When the scaffold has been rolled to its intended point of use, casters 20 and 21 are locked against rolling movement. The rear outriggers 34 and 35 are unlatched and allowed to swing downwardly so that their pads rest on the ground. Cage 12 is pivoted about hinge 15 to its use position and latched in place to the ladder unit. At this time, the forward outriggers 32 and 33 are preferably swung to their operative position, and the brace means 45 therefore locked with their brace tubes in their in-line relation. The scaffold is now as shown in FIG. 7.

Figure 8:
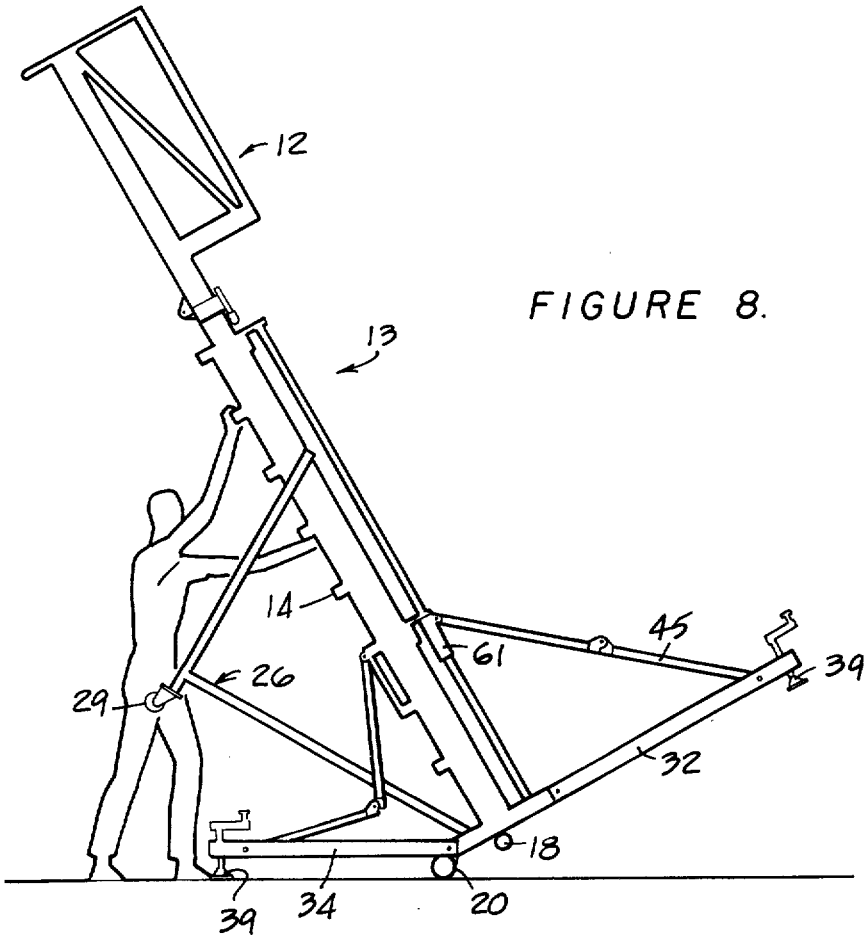

With casters 20 and 21 locked, the scaffold is now rotated upwardly about those casters, as shown in FIG. 8. The wheel support frames 26 and 27 provide several functions which enable easy and safe use of the scaffold. First, since the wheel support frames space the wheels 29 substantially outwardly from the ladder unit, a considerable initial inclination of the ladder unit is provided so that the workman can get beneath the ladder unit and push up thereon, which is easier than lifting dead weight. Also, as will be noted in FIG. 8, when the workman is pushing up on the ladder unit, he is standing between the wheel support frames. If, for any reason, the ladder should fall backwardly (for example, if the workman forgot to lock casters 20 and 21, or did not lock them properly, or if the workman should slip), the descent of the ladder unit will be stopped by engagement of wheels 29 with the ground, and the workman between the wheel support frames 26 and 27 will be thereby protected against the scaffold falling on him.

Figure 9:
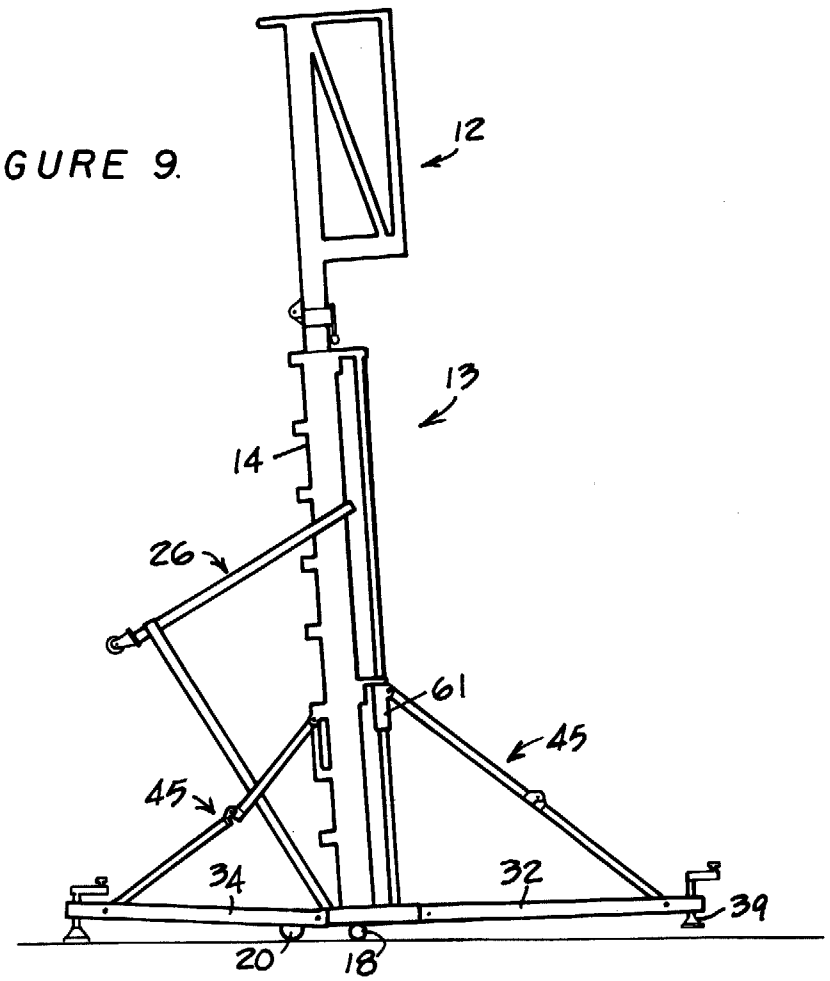

The workman continues to rotate the scaffold upwardly about the locked caster wheels 20 and 21 until caster wheels 18 and 19 come into engagement with the ground (FIG. 9). With the scaffold now resting on all four casters, the center of gravity of the scaffold will be vertically within the support area defined by the casters so that the scaffold will stand by itself. The forward outriggers 32 and 33 are preferably mounted on the scaffold so that they will swing down automatically by gravity to their operative positions when the scaffold is in the FIG. 8 position in case the workman had forgotten to do so already. It is for this reason that the forward outriggers are not latched to the ladder unit when in their storage positions.

As seen in FIG. 9, with the rear outriggers 34 and 35 unlocked, and with the scaffold free standing on its four casters, the ladder unit has a very perceptible rearward lean to provide discouragement to a workman who might want to climb the ladder before the rear outriggers are set. Even if he should try to climb the ladder, the shaky feeling resulting from the small support area provided by just the four castsers 18–21 will quickly remind him that the outriggers are not set. Even if this warning were disregarded, the workman could not climb very high before his weight would cause the scaffold to fall rearwardly to its FIG. 7 position. The wheel support frames 26 and 27 will again help to protect the workman if this extreme workman error should occur.

Figure 10:
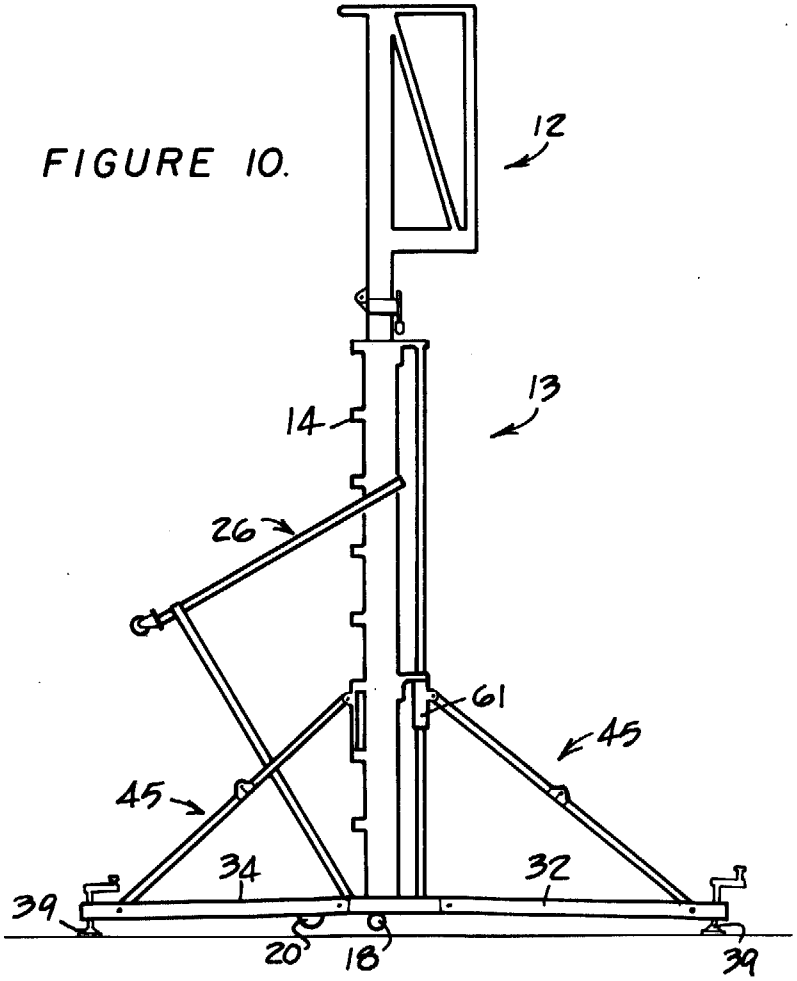

To complete the erection of the scaffold, the workman pulls upwardly and outwardly on the brace means for the rear outriggers 34 and 35 so that they lock with their brace tubes in their in-line relations, first on one rear outrigger and then the other. As the rear outrigger brace means are forced toward their locked position, the scaffold will pivot about casters 18 and 19 so that the forward outrigger pads 38 move down into ground engagement and the ladder unit becomes more vertical. Final movement of the rear outrigger brace means to their in-line and locked position will then cause base 12 to lift so that casters 18 and 19 are off the ground (FIG. 10) and the ladder unit is vertical. In this position, all of the weight of the scaffold is now borne by the four outrigger pads 39 and the scaffold is very stably supported thereby. Since the casters are all off the ground and since the outrigger pads are non-rolling, the fully erected scaffold is very resistant to lateral movement on the ground, so that it cannot be easily moved.

The ladder unit can now be extended to raise the work cage to the desired height and the workman can safely ascent thereto.

Figure 6:
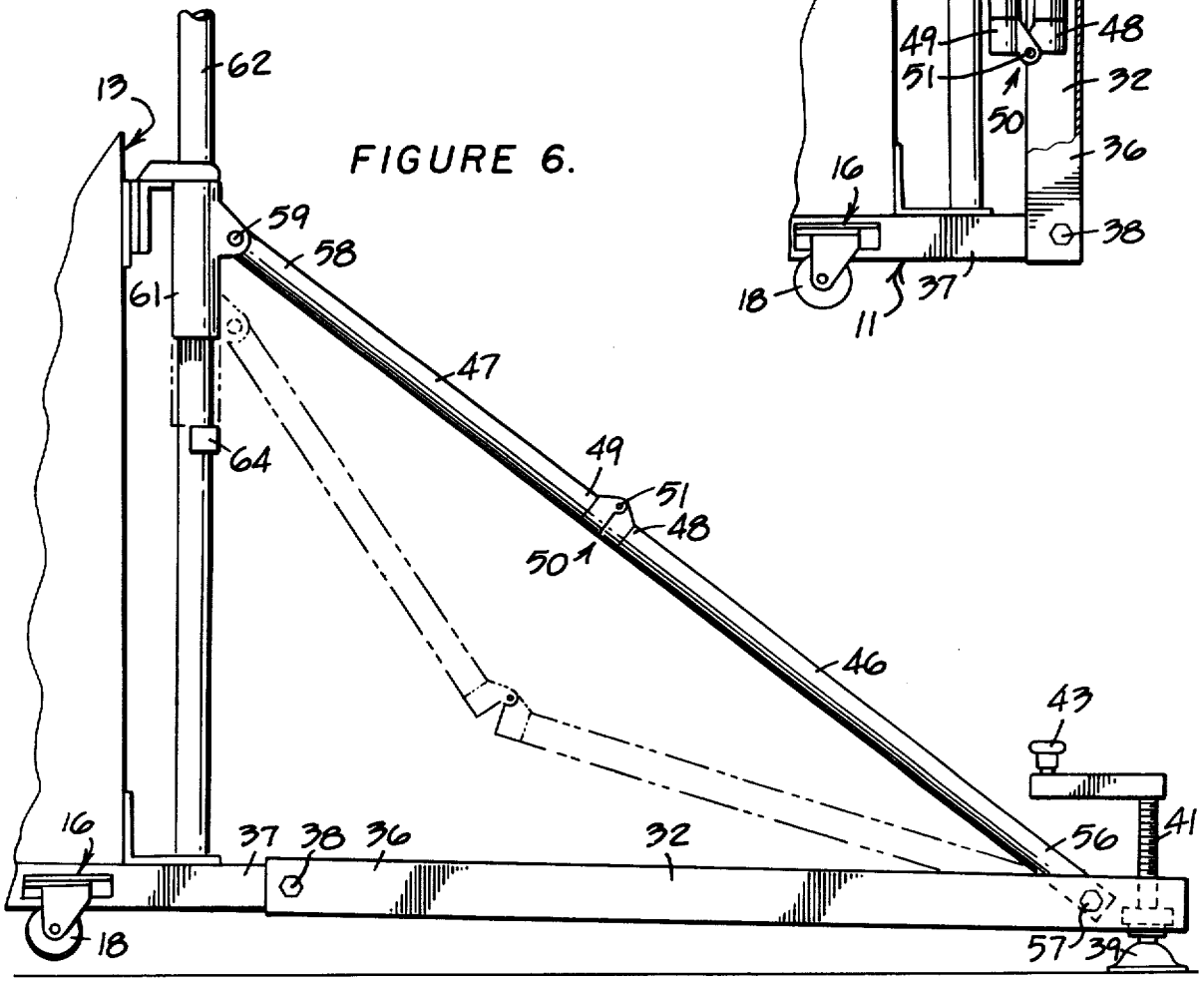
FIG. 6 is a view similar to FIG. 4, showing the rear outrigger folded down in operative position.

If the workman had failed to lock the forward outrigger braces 45 prior to elevating the ladder unit to the position shown in FIG. 9, i.e. wherein the scaffold is free standing on its four casters, the forward outrigger braces will assume the position shown in phantom in FIG. 6. Unless the workman is quite unobservant, he will readily notice that the forward outrigger braces are not in their in-line position and he will lock them in position before proceeding further.

In erecting the scaffold, and in pivoting the scaffold upwardly about casters 20 and 21 from the position of FIG. 8 to the position of FIG. 9, the workman will normally stop pushing against the ladder unit when the center of gravity of the scaffold passes forwardly of the vertical plane defined by casters 20 and 21 and the scaffold rocks forwardly until casters 18 and 19 engage the ground, the scaffold being then supported on all four casters. If the workman were to continue pushing the ladder unit forwardly, the scaffold would pivot about casters 18 and 19, but such movement would stop when the pads 39 of the forward outrigger come into engagement with the ground, providing the brace for these outriggers are locked, so that the ladder unit is stably supported. The rear outrigger can then be locked in place to raise casters 18 and 19 off of the ground, as before.

Figure 11:
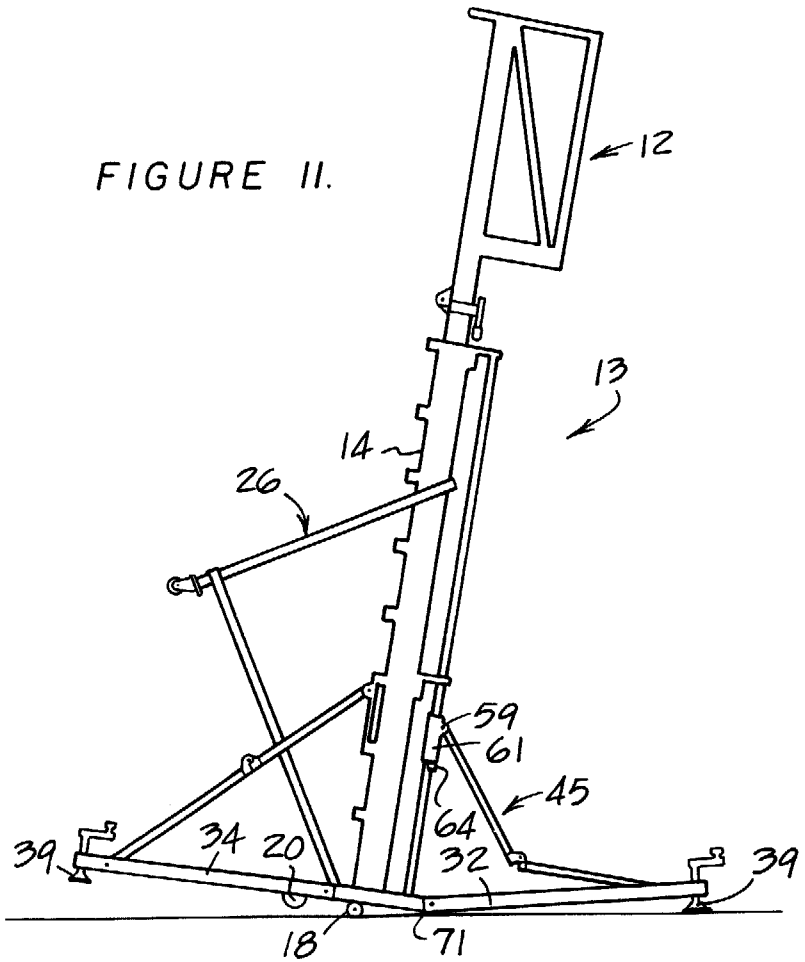
FIG. 11 is a simplified view of the pedestal scaffold of FIG. 1, illustrating the manner in which the scaffold may be supported if the rear outriggers are not locked.

In the event that the forward outrigger braces had not been locked and the workman should push against the ladder unit with enough force to pivot it about casters 18 and 19, the ladder unit will pivot around casters 18 and 19 until the auxiliary ground-engageable means 71 mounted on the base come into engagement with the ground, as shown in FIG. 11. As specifically illustrated herein, the auxiliary means 71 are the end portions of the forward outriggers 32 and 33 which are pivotally connected to the scaffold base. Preferably, these ground-engageable end portions 71 are arranged relative to casters 18 and 19 so that they are sufficiently far forward of and above the bottoms of casters 18 and 19 such that when the end portions 71 and casters 18 and 19 will engage the ground, the center of gravity of the scaffold, with the ladder unit telescopically retracted, is vertically above and near the perimeter of the area defined between the points of ground engagement of the end portions 71 and the casters 18 and 19, and the angle between horizontal and the climbing side of the ladder is substantially greater than 90°. With two ground-engageable end portions 71, the center of gravity of the scaffold will be near the vertical plane defined by the two end portions 71.

The center of gravity should be sufficiently far forward of the vertical plane defined by casters 18 and 19 so that the ladder unit will rotate sufficiently about casters 18 and 19 before base portions 71 engage the ground so that the workman will realize from the pronounced forward lean of the ladder unit and the jolt when base portions 71 engage the ground, that the forward outriggers have not been locked in place. The workman will then pull the ladder unit backwardly towards him so that the scaffold rotates about casters 18 and 19 until it comes back to the free standing position with all four casters engaging the ground. He will then lock the forward outrigger and then the rear outriggers. The center of gravity of the scaffold, when end portions 71 and casters 18 and 19 engage the ground, should also be sufficiently forward of casters 18 and 19 so that the ladder unit has such a pronounced forward lean and the scaffold has such an instability that no workman would be tempted to try and ascend the ladder unit.

The scaffold may be made to be free standing, when supported by casters 18 and 19 and end portions 71 and with the ladder unit telescopically retracted, by having the center of gravity at or rearward of the vertical plane of end portions 71. However, if the workman should then try to extend the ladder unit, the center of gravity would shift forwardly of end portions 71 so that the resulting instability would prevent use of the scaffold, forcing the workman to follow correct procedures before he could use the scaffold.

End portions 71 can also be located relative to casters 18 and 19 so that when the scaffold is in the FIG. 11 position, the center of gravity is forward of the vertical plane of base portions 71. In such case, the scaffold will not be free standing when portions 71 engage the ground, again giving notice to the workman that he must rock the scaffold back to the FIG. 9 position before proceeding further. In such case, the center of gravity should be not too far forwardly of the plane of base portions 71 so that undue effort on the part of the workman will not be required to hold the ladder unit against falling forwardly or to rock it back to the FIG. 9 position.

If the scaffold is in the free standing position of FIG. 9, and the front outriggers are unlocked, locking of the rear outriggers will also cause the scaffold to move to the position of FIG. 11, again providing the pronounced forward lean and instability which will prevent use of the scaffold until the workman locks the front outrigger braces.

There will be occasions when a workman is working in the cage and the work becomes out of reach. Rather than descending from the ladder, moving the scaffold and then climbing back to the work cage, the workman could well wish that he could remain in the cage and pull the scaffold horizontally by grasping the ceiling or wall or have someone else push the scaffold to the desired point. Some pedestal scaffolds will permit such movement while the workman is in the work cage, but this is a highly unrecommended procedure, particularly if the ladder unit is at all extended.

Such procedure, however, cannot be carried out with the present scaffold. Since the scaffold when in use is not supported by rolling casters but only by the nonrolling outrigger pads, its lateral position cannot be changed. In order to shift the scaffold, the outrigger would have to be unlocked to lower the scaffold onto its casters 18–21, but no workman in the cage would be willing to have someone do that.

Figure 12:
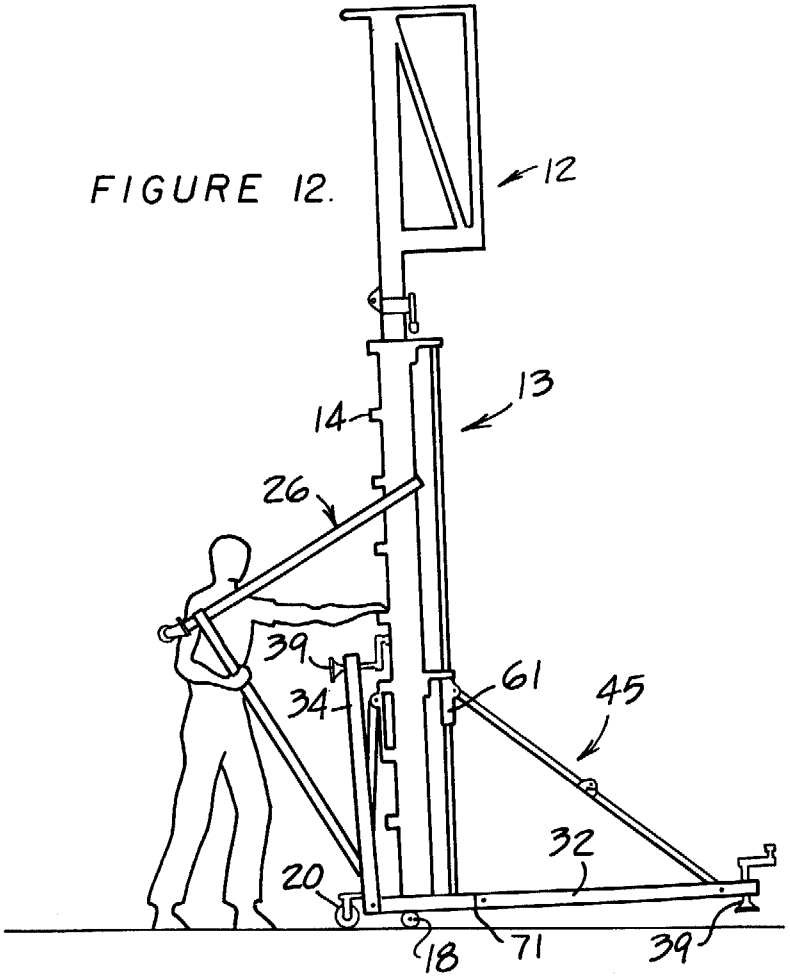
FIG. 12 is a simplified view of an alternative way in which the pedestal scaffold may be moved.

As a consequence, the workman is forced to follow a safe procedure in the event he wants to shift the position of the scaffold. Thus, he will descend the ladder, unlock the casters 20 and 21, unlock the braces for the outriggers 34 and 35 and fold the outriggers to their storage position, and tilt the ladder unit rearward so that the base rests on all four casters 18–21. The scaffold is now balanced on those casters and the whole unit can be rolled to its newly desired position, as shown in FIG. 12. During such movement the forward outriggers 32 and 33 can be left locked in place. At the new position the rear outriggers are again locked in operative position so that the scaffold can again be used.

To lower the scaffold for longer moves or storage, the ladder unit is retracted, the rear outriggers are unlocked, retracted and latched to the ladder unit. The casters 20 and 21 are locked and the unit is rotated about those casters to rest on wheels 29, i.e., as in FIG. 7. The forward outriggers are retracted. The cage 12 is unlocked, swung to storage position and latched to the ladder unit, i.e., as in FIG. 2. Casters 20 and 21 are then unlocked and the scaffold is rolled to wherever desired.

What is claimed is:

1. A pedestal scaffold comprising:

(a) a base, (b) first and second caster means mounted on said base, each caster means including at least one ground-engageable caster, there being at least three casters in all, said casters defining therebetween a support area when all of said casters engage the ground, (c) an elongated ladder unit having a climbing side, said ladder unit being mounted at one end thereof on said base and extending generally vertically upwardly from said base with the center of gravity of said scaffold being vertically within said support area when all of said casters are in engagement with level ground, (d) at least three elongated outrigger members, each connected at one end therefore to said base and having a ground-engageable element at the other end thereof for engagement with the ground outwardly from said base, (e) a lockable brace means for each of said outrigger members for positioning said outrigger members relative to said base, when all of said outrigger elements engage the ground and all of said brace means are locked, such that the climbing side of the ladder is vertical and all of said casters are above ground.

2. A pedestal scaffold as set forth in claim 1 and further including:

means for adjusting the spacing between each ground-engaging element and the outrigger member on which it is mounted.

3. A pedestal scaffold as set forth in claim 1, wherein said first and second caster means are arranged on said base such that the angle between horizontal and the climbing side of the ladder is substantially less than 90° when all of said casters of said first and second caster means are in engagement with level ground.

4. A pedestal scaffold as set forth in claim 3 and further including auxiliary ground-engageable means mounted on said base and arranged relative to said second caster means such that when said auxiliary ground-engageable means and said second caster means together engage the ground, the center of gravity of the scaffold is vertically above and near the perimeter of the area defined between the points of ground-engagement of said auxiliary ground-engageable means and said second caster means, and the angle between horizontal and the climbing side of said ladder is substantially greater than 90°.

5. A pedestal scaffold as set forth in claim 3 and further including:

a pair of spaced-apart wheel support frames mounted on said ladder unit and extending a substantial distance outwardly from the climbing side thereof;

a ground-engageable wheel mounted on each of said wheel support frames, said wheels and said first caster means being simultaneously engageable with level ground to support said scaffold thereon with the climbing side of said ladder unit being inclined and facing downwardly, and with the center of gravity of said scaffold being vertically within the support area defined between the points of ground-engagement of said wheels and said first caster means.

6. A pedestal scaffold as set forth in claim 5 and further including auxiliary ground-engageable means mounted on said base and arranged relative to said second caster means such that when said auxiliary ground-engageable means and said second caster means together engage the ground, the center of gravity of the scaffold is vertically above and near the perimeter of the area defined between the points of ground-engagement of said auxiliary ground-engageable means and said second caster means and the angle between horizontal and the climbing side of said ladder being substantially greater than 90°.

7. A pedestal scaffold as set forth in claim 1 and further including:

a pair of spaced-apart wheel support frames mounted on said ladder unit and extending a substantial distance outwardly from the climbing side thereof, a ground engageable wheel mounted on each of said wheel support frames, said wheels and said first caster means being simultaneously engageable with level ground to support said scaffold thereon with the climbing side of said ladder unit being inclined and facing downwardly, and with the center of gravity of said scaffold being vertically within the support area defined between the points of ground-engagement of said wheels and said first caster means.

8. A pedestal scaffold as set forth in claim 1, wherein each of said outrigger members is pivotally connected at said one end thereof to said brace for pivotal movement of said outrigger member between a storage position generally parallel to said ladder unit and an outward ground-engaging position, and wherein each of said brace means includes:

first and second tubes each having first and second ends, means pivotally connecting the first ends of said first and second tubes together for pivotal movement of said tubes between a generally parallel relationship and an in-line relationship, means pivotally connecting the second end of said first tube to one of said outrigger members at a point thereon away from its one end, means pivotally connecting the second end of said second tube to said ladder unit at a point thereon away from said base, means for releasably locking said first and second tubes against relative movement therebetween when in said in-line relationship.

9. A pedestal scaffold as set forth in claim 8 wherein each outrigger member comprises an elongated open channel member and wherein said first tube is receivable within said channel member when said first and second tubes are pivoted into their generally parallel relationship.

10. A pedestal scaffold as set forth in claim 8 wherein said ladder unit includes an elongated guide member, wherein one of the means pivotally connecting the second end of said second tube to said ladder unit includes a slide member slidably mounted on said guide member and further including a stop means on said guide member for preventing sliding movement of said slide member away from said base when said first and second tubes are locked in their in-line relationship, said slide member being feeely slidable on said guide member away from said stop means and towards said base when said first and second tubes are not in their in-line relationship.

11. A pedestal scaffold as set forth in claim 8, wherein said first and second caster means are arranged on said base such that the angle between horizontal and the climbing side of the ladder is substantially less than 90° when all of said casters of said first and second caster means are in engagement with level ground.

12. A pedestal scaffold as set forth in claim 11 and further including auxiliary ground-engageable means mounted on said base and arranged relative to said second caster means such that when said auxiliary ground-engageable means and said second caster means together engage the ground, the center of gravity of the scaffold is vertically above and near the perimeter of the area defined between the points of ground-engagement of said auxiliary ground-engageable means and said second caster means and the angle between horizontal and the climbing side of said ladder is substantially greater than 90°.

13. A pedestal scaffold as set forth in claim 11 wherein said ladder unit includes an elongated guide member, wherein one of the means pivotally connecting the second end of said second tube to said ladder unit includes a slide member slidably mounted on said guide member and further including a stop means on said guide member for preventing sliding movement of said slide member away from said base when said first and second tubes are locked in their in-line relationship, said slide member being freely slidable on said guide member away from said stop means and towards said base when said first and second tubes are not in their in-line relationship.

14. An outrigger assembly for a scaffold having a ground-engageable support base and a vertical column extending upward from said base, said outrigger assembly comprising:

a vertically elongated guide member on said column, a slide member slidably mounted on said guide member, an elongated outrigger member pivotally connected at one end thereof to said base and having a ground-engaging element at the other end thereof, said outrigger member being movable between a generally vertical storage position and a generally horizontal ground-engaging position, first and second brace tubes each having first and second ends, means pivotally connecting the first ends of said tubes together for pivotal movement of said tubes between a generally parallel relationship and an in-line relationship, means pivotally connecting the second end of said first brace means to said outrigger member, means pivotally connecting the second end of said second brace tube to said slide member, stop means associated with said guide member and engageable with said slide member for preventing upward sliding movement of said slide member when said first and second brace tubes are in their in-line relationship, said slide member being freely slidable downwardly on said guide member when said outrigger member is in its ground-engaging position and said brace tubes are not in their in-line relation, means for releasably locking said first and second brace tubes against relative movement therebetween when in said in-line relationship.

15. An outrigger assembly as set forth in claim 14 wherein said outrigger member comprises an elongated open channel member and wherein said first brace tube is receivable within said channel member when said first and second brace tubes are pivoted into their generally parallel relationship.

16. A scaffold comprising:

a generally horizontal base, ground-engaging caster means mounted on said base, vertically extending column means mounted on said base and having an elevated work station at the upper end thereof, at least three elongated outrigger members, each pivotally connected at one end thereof to said base and having a ground-engaging element at the other end thereof, each outrigger member being movable between a generally vertical storage position and a generally horizontal ground-engaging position, a lockable brace means for each outrigger member, each brace means including first and second brace tubes pivotally interconnected for movement of said tubes between a generally parallel relation to an in-line relation, each first brace tube being pivotally connected to one of said outrigger members away from its one end and each second brace tube being pivotally connected to said column means above said base, each brace means including means for releasably locking said first and second brace tubes thereof against relative movement therebetween when in their in-line relation, the lengths of said brace means being such that said caster means engage the ground and said outriggers have been pivoted downwardly into their generally horizontal ground-engaging position, subsequent movement of all of the first and second brace tubes to their in-line relation will raise said caster means above the ground.

17. A scaffold as set forth in claim 16 wherein the pivotal connection of at least one of said second brace tubes to said column means includes a slide member connected to said second tube and vertically slidable on said column means.

18. A scaffold as set forth in claim 16 wherein said caster means is operative to support said base and column means thereon with a substantial inclination of said column means from vertical when said caster means engage level ground.

19. A scaffold as set forth in claim 18 wherein the pivotal connection of at least one of said second brace tubes to said column means includes a slide member connected to said second brace tube and vertically slidable on said column means.

* * * * *